United States Patent [19]

Weber et al.

[11] Patent Number: 5,022,830

[45] Date of Patent: Jun. 11, 1991

[54] SUBMERGED FUEL PUMP

[75] Inventors: Rainer J. Weber, Kirchhausen; Johann Attenni, Wettstetten, both of Fed. Rep. of Germany

[73] Assignee: Audi AG, Ingolstadt, Fed. Rep. of Germany

[21] Appl. No.: 442,327

[22] PCT Filed: May 5, 1988

[86] PCT No.: PCT/DE88/00267

§ 371 Date: Nov. 13, 1989

§ 102(e) Date: Nov. 13, 1989

[87] PCT Pub. No.: WO88/08929

PCT Pub. Date: Nov. 17, 1988

[30] Foreign Application Priority Data

May 12, 1987 [DE] Fed. Rep. of Germany ... 8706776[U]

[51] Int. Cl.[5] ..... F04B 35/04

[52] U.S. Cl. ..... 417/423.14; 417/572

[58] Field of Search ..... 417/424.1, 423.14, 424.2, 417/572; 418/166, 171, 259; 222/377, 385

[56] References Cited

U.S. PATENT DOCUMENTS

| | | | |
|---|---|---|---|
| 2,474,009 | 6/1949 | Molyneux | 418/166 |
| 2,485,980 | 10/1949 | McClure | 417/271 |
| 3,964,836 | 6/1976 | Navelsaker | 417/424.1 |
| 4,466,781 | 8/1984 | Kemmner et al. | 417/423.14 |
| 4,619,588 | 10/1986 | Moore | 418/171 |
| 4,629,399 | 12/1986 | Friebe | 418/171 |
| 4,784,587 | 11/1988 | Takei et al. | 417/423.14 |

FOREIGN PATENT DOCUMENTS

| | | | |
|---|---|---|---|
| 535408 | 11/1955 | Italy | 417/424.1 |

*Primary Examiner*—Leonard E. Smith
*Assistant Examiner*—John A. Savio, III
*Attorney, Agent, or Firm*—Kane, Dalsimer, Sullivan, Kurucz, Levy, Eisele and Richard

[57] ABSTRACT

An internal tank/fuel pump unit has a vertically disposed, cylindrical unit housing 1 with an open lower end 3, into which a base plate 4 is inserted, which contains a suction channel 6, which goes out from the outer surface 5 of the base plate and terminates in a suction orifice 7 in the inner surface 8. In order largely to prevent the formation of gas bubbles, the outer surface 5 of the base plate 4 is smooth and terminates flush with the edge 9 of the unit housing 1.

4 Claims, 2 Drawing Sheets

SUBMERGED FUEL PUMP

The invention relates to an internal tank/fuel pump unit with a vertically disposed, cylindrical unit housing, which has an open lower end, in which is inserted a base plate, which contains a suction channel, which runs from the outer surface of the base plate and terminates in a suction orifice in the inner surface of the base plate.

With the known internal tank pumps of this type, gas bubbles are formed under the pump on the outer surface of the base plate, especially when the fuel is heated strongly. The gas bubbles can interfere with the pumping operation or cause it to be brought to a complete stop. One of the causes of the formation of such gas bubbles may lie therein that, in the known pumps, because of the construction and arrangement of the base plate, local regions of different pressures which favor the formation of gas bubbles, arise in the fuel on its way along the base plate to the suction channel and the suction orifice.

The DE-U No. 8,603,736 discloses a fuel pump, in which a screen, which has a convexly curved shape, for example, is disposed in front of the base plate. This screen is intended to prevent the formation of a gas-bubble cushion at the outer surface of the screen. Such a gas-bubble cushion would interfere with the transport of the fuel, since it may be expected that the gas bubbles formed, because of their lower specific gravity, can rise along the outer surface of the screen towards the edge of the screen and then furthermore upwards along the outer surface of the pump. However, it has turned out that such a screen, if anything, promotes the formation of gas bubbles because of its flow resistance.

In principle, the same disadvantages also occur in the construction according to the French Publication No. 980,744, in which a suction basket, which has rounded edges at the periphery and is furnished with slits, is provided ahead of the base plate. In this construction, the base plate has a plane middle region, which contains the suction orifice. Adjoining the middle region is an inclined edge region, so that, even if the suction basket is omitted, the gas bubbles necessarily formed at higher temperatures and collected on the underside of the base plate, do not migrate towards the outside but are carried along by the aspirated fuel and reach the central suction orifice.

It is an object of the invention to provide an internal tank/fuel pump unit of the generic type, in which the tendency to form gas bubbles is reduced and the entry of gas bubbles into the suction channel is largely avoided.

In the inventive internal tank pump, there are in the path of the fuel flowing to the suction orifice no corners or edges, which can lead to pressure jumps in the flow. Accordingly, the tendency to form gas bubbles is reduced appreciably. Because of the convex shape of the outer surface of the base plate or the insert, the gas bubbles, which nevertheless are formed especially at high temperatures, can bead away radially towards the outside and then upwards along the outer surface of the unit housing. Due to the proposed shape of the suction channel, an adequate cross section for the suction channel or for the flow path of the fuel to the suction channel can be ensured despite the convexly curved shape of the outer surface of the base plate or of the insert, while the distance from the base of the fuel tank is kept as small as possible.

Preferably, the edge surrounding the suction channel is highly rounded off, in order to prevent as far as possible a pressure jump as the fuel flows around this edge.

Two embodiments of the invention are described in the following with reference to the drawings.

Figure 1:
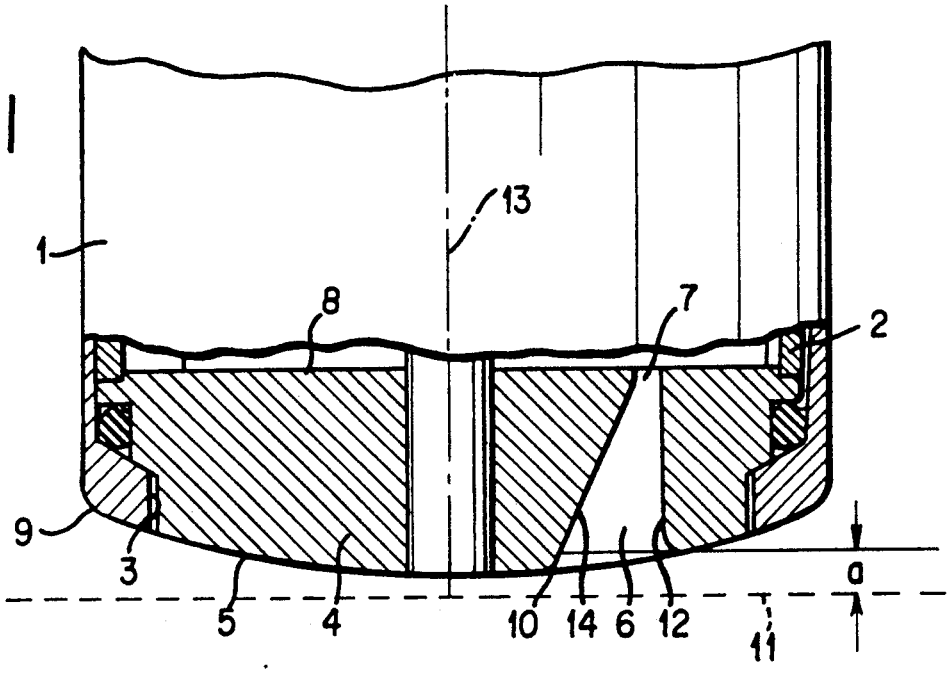
FIG. 1 shows a partial longitudinal section of an internal tank/fuel pump unit with a base plate constructed pursuant to the invention.
Figure 2:
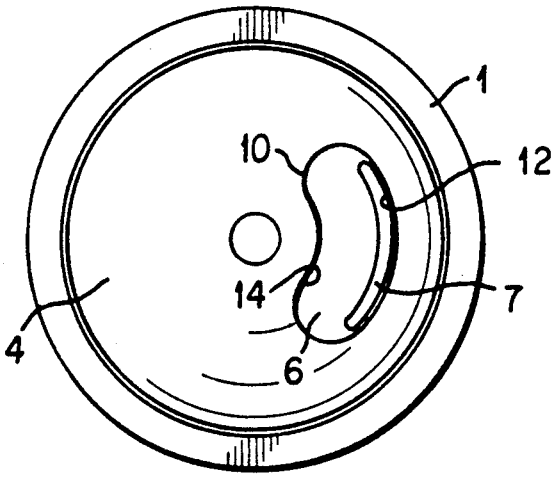
FIG. 2 shows a plan view of the unit represented in FIG. 1 from below, that is, in the direction of the base plate, on a smaller scale.

The internal tank/fuel pump unit shown in FIG. 1 has a vertically arranged cylindrical unit housing 1, in which a unit 2, consisting of a fuel pump and an electric motor driving this fuel pump, is disposed. The unit housing has an open lower end 3, in which a base plate 4 is inserted, from the outer surface 5 of which a suction channel 6 goes out, which terminates in a suction orifice 7 at the inside 8 of the base plate 4. The outer surface 5 of the base plate 4 is smooth and curved convexly and terminates flush with the edge 9 of the unit housing 1. A can be seen from FIG. 2, the suction channel 6 is kidney-shaped and constricted in funnel-shape fashion towards the also kidney-shaped suction orifice 7. As can be seen from FIG. 1, the edge 10, which surrounds the suction channel 6, is highly rounded off.

Due to the shown construction of the outer surface 5 of the base plate 4 and the outlet of the suction channel 6, edges and corners in the path of flow of the fuel towards the suction orifice 7 are avoided, so that pressure jumps in the flow, which give rise to the formation of gas bubbles, do not occur. Any gas bubbles, which are nevertheless formed, are conducted radially to the outside by the convex shape of the outer surface 5 and can rise along the outer surface of the unit housing 1.

Figure 4:
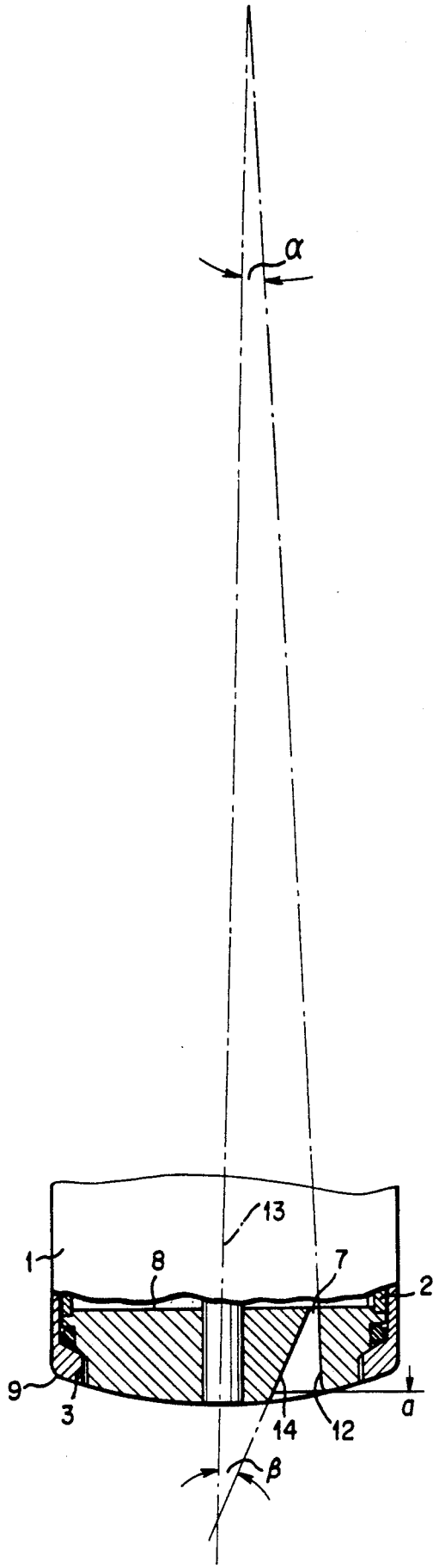
FIG. 4 is a partial longitudinal section of an internal tank/fuel pump unit which illustrates the angles of the radially inner and outer walls of the kidney shaped port with respect to the longitudinal centerline of the pump.

The fuel tank is to be emptied as far as possible with internal tank pumps. This presupposes that the distance between the suction orifice or the outlet of the suction channel 6 and the base 11 of the fuel tank, which is shown by a broken line, is as small as possible. To keep this distance a as small as possible and nevertheless maintain an adequate cross section for the suction channel 6, as seen in FIG. 4 the angle $\alpha$ enclosed by the radially outer wall 12 of the suction channel 6 and the longitudinal center line 13 of the unit housing 1 is smaller the angle $\beta$ that enclosed by the radially inner wall 14 and the longitudinal center line 13.

Figure 3:
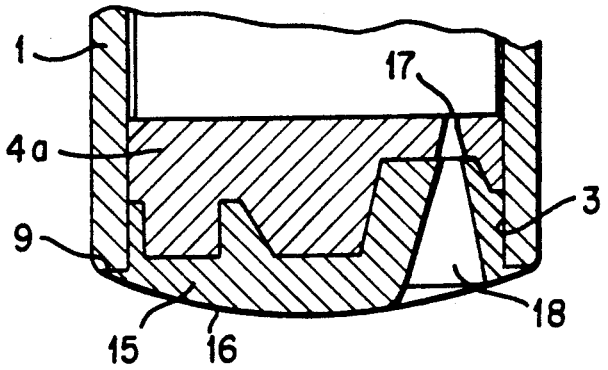
FIG. 3 shows a section similar to that of FIG. 1, with an insert placed on a conventional base plate.

In the construction of FIG. 3, an insert 15 is placed on the conventional base plate 4*a*, which has a fissured outer surface, that is set back with respect to the edge 9 of the unit housing 1. Similarly to the base plate 4 of FIG. 1, the insert 15 has a convexly curved, smooth outer surface 16, which in this case overlaps the edge 9 of the unit housing 1. The insert 15 contains a suction channel 18, which is aligned with the suction orifice 17 in the base plate 4*a*, expands in funnel-shape fashion towards the outside and is again constructed in the manner described in connection with FIG. 1. Existing pump units can be retrofitted by means of this insert 15, which is attached to the base plate 4*a*, for example, by adhesion.

The base plate 4 or the insert 15 may consist of plastic or also of metal, preferably aluminum.

The base plate 4 of FIG. 1 may also be constructed so that, like insert 15 of FIG. 3, it overlaps the edge 9 of the unit housing. Conversely, the insert 15 of FIG. 3 may be constructed so that its outer surface 16 terminates flush with the edge 9 of the unit housing 1.

The inventive pump unit preferably is used in conjunction with a so-called fuel spinner, which is surrounded by a screen that keeps contamination away from the pump. As a result, there is no need to provide a screen directly in front of the suction orifice or the suction channel of the pump. Such a screen would contribute to the formation of gas bubbles because of the pressure drop that it produces.

We claim:

1. A fuel pump for submersion in a fuel tank, comprising a vertically disposed cylindrical housing with an open lower end, a circular base means inserted into said lower end and having an outer and an inner surface and containing a suction passage starting from said outer surface and terminating in a suction port in the inner surface, said suction passage having a kidney-shaped cross section and being disposed eccentrically with respect to a longitudinal center line of the housing and having radially outer and inner walls, wherein a. said outer surface is smooth and has a convex shape;

b. the radially outer and inner walls of said suction passage converge toward said suction port whereby the radially outer wall includes with said longitudinal center line an angle which is smaller than the angle which the radially inner wall includes with said longitudinal center line; and c. the edge of the suction passage is rounded off extensively towards the outer surface of the base means.

2. The invention in accordance with claim 1 wherein the base means includes a plate.

3. The invention in accordance with claim 2 wherein the outer surface of the plate overlaps an adjacent edge of the housing.

4. The invention in accordance with claim 2 wherein a circular insert plate is placed upon said base plate and has the smooth and convex surface and overlaps an adjacent edge of the housing, said insert plate containing a suction channel of kidney-shaped cross section concentric with respect to said longitudinal center line which channel starts from the outer surface and terminates in the suction passage.

* * * * *